US009256239B2

(12) United States Patent
Ramirez et al.

(10) Patent No.: US 9,256,239 B2
(45) Date of Patent: Feb. 9, 2016

(54) VOLTAGE CONTROLLING CIRCUIT

(75) Inventors: Oscar Ramirez, Spring Grove, IL (US); Cal T. Swanson, St. Louis, MO (US); Jeffrey Reiman, St. Charles, MN (US)

(73) Assignee: WATLOW ELECTRIC MANUFACTURING COMPANY, St. Louis, MO (US)

( * ) Notice: Subject to any disclaimer, the term of this patent is extended or adjusted under 35 U.S.C. 154(b) by 417 days.

(21) Appl. No.: 13/050,371

(22) Filed: Mar. 17, 2011

(65) Prior Publication Data

US 2012/0235655 A1 Sep. 20, 2012

(51) Int. Cl.
*G05F 1/00* (2006.01)
*G05F 1/595* (2006.01)

(52) U.S. Cl.
CPC ..... *G05F 1/595* (2013.01)

(58) Field of Classification Search
USPC ..... 323/265, 266, 268, 269, 270, 272, 273, 323/274, 275, 276; 361/18, 90, 91.1
See application file for complete search history.

(56) References Cited

U.S. PATENT DOCUMENTS

| | | | | |
|---|---|---|---|---|
| 4,441,070 | A | 4/1984 | Davies et al. | |
| 4,754,388 | A * | 6/1988 | Pospisil | 363/54 |
| 5,528,127 | A | 6/1996 | Streit | |
| 6,094,040 | A * | 7/2000 | Meier et al. | 323/284 |
| 6,133,779 | A | 10/2000 | Sichert et al. | |
| 6,404,076 | B1 * | 6/2002 | Matsuda et al. | 307/80 |
| 6,710,585 | B2 * | 3/2004 | Schmitt et al. | 323/281 |
| 7,002,869 | B2 | 2/2006 | Zhang et al. | |
| 7,283,338 | B2 * | 10/2007 | Salvatore | 361/18 |
| 7,715,216 | B2 * | 5/2010 | Liu et al. | 363/89 |
| 2003/0169024 | A1 * | 9/2003 | Cook | 323/268 |
| 2004/0218405 | A1 | 11/2004 | Yamada | |

FOREIGN PATENT DOCUMENTS

| | | |
|---|---|---|
| DE | 35 38 584 | 5/1987 |
| DE | 41 10 495 | 10/1992 |
| GB | 943 327 | 12/1963 |
| GB | 2 386 208 | 9/2003 |

OTHER PUBLICATIONS

PCT Serial No. PCT/US2012/029450—International Search Report and the Written Opinion of the International Searching Authority, Dated May 3, 2013.

* cited by examiner

*Primary Examiner* — Nguyen Tran
(74) *Attorney, Agent, or Firm* — Brinks Gilson & Lione

(57) ABSTRACT

A voltage controlling circuit with power sharing components is provided. The circuit includes a voltage regulator for controlling an output voltage for a load and a device in communication with the voltage regulator for power sharing.

17 Claims, 6 Drawing Sheets

VOLTAGE CONTROLLING CIRCUIT

BACKGROUND

Field of the Invention

The present invention generally relates to a voltage controlling circuit with power sharing components which allow it to operate at higher ambient temperatures.

SUMMARY

A voltage controlling circuit with power sharing components is provided. The circuit includes a voltage regulator for controlling an output voltage for a load and a device in communication with the voltage regulator for dissipating power.

Further objects, features and advantages of this invention will become readily apparent to persons skilled in the art after a review of the following description, with reference to the drawings and claims that are appended to and form a part of this specification.

DETAILED DESCRIPTION

Typical voltage regulator power parameters do not always meet customer's power supply input and thermal ambient requirements. The problems with these circuits is that a voltage drop may be created in the power boosting/power-dissipation-sharing circuitry causing the power dissipation/distribution between the voltage regulator and the added component to not be optimized. These two constraints may prevent systems from satisfying customer voltage and thermal requirements.

In order to allow a voltage regulator to meet extended supply voltage and thermal requirements, the implementations described below may be utilized. Each implementation adds large power-handling/high junction-capable components to the typical voltage regulation circuits in order to together produce a superior power supply circuit which is capable of operating at high ambient temperatures, up to 120 C, and which can operate with a large supply voltage range, 6 to 18 VDC.

Figure 1:
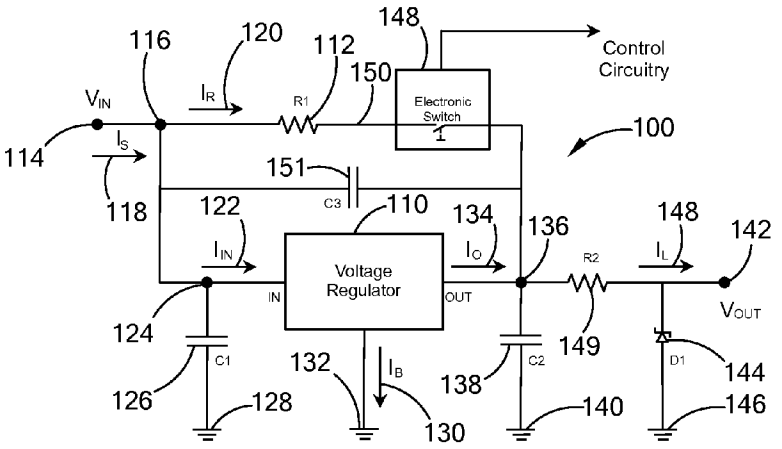
FIG. 1 is a voltage controlling circuit with power sharing components.

Now referring to FIG. 1, a circuit for controlling voltage is provided. The circuit includes a voltage regulator 110 and a resistor 112. The circuit also includes an electronic switch 148 (E-SW1) and zener diode 144 (Z1). Capacitor 151 is connected between node 124 and node 136 and thus it is connected in parallel with the input and output of the voltage regulator 110. This capacitor is provided for line transient noise and EMI purposes. The voltage regulator 110 may be a voltage regulator chip, for example provided in an integrated circuit package. Further, the voltage regulator provides a fixed output voltage for a wide range of input voltages and may include protection circuitry common for integrated circuit type voltage regulators. One example, of such a device includes the LM2931 style voltage regulator. The resistor 112 is in an electrically parallel connection with the voltage regulator 110 to dissipate power and help source the voltage regulator load. As such, the resistor 112 and the voltage regulator 110 form a feed forward loop. An input voltage 114 is provided to the circuit 100 at node 116. The source current through node 116 is identified by arrow 118. Node 116 is connected to node 124 which in turn is connected to the input of the voltage regulator 110. The input current provided to the voltage regulator 110 is denoted by arrow 122. Further, for filtering purposes, a capacitor 126 is connected between node 124 and an electrical reference 128 such as electrical ground. A ground pin of the voltage regulator 110 may be connected to an electrical reference 132 such as electrical ground. The current that travels from the voltage regulator 110 to electrical ground through the ground pin is denoted by arrow 130. An output of the voltage regulator 110 may be connected to node 136. The output current from the voltage regulator is denoted by arrow 134. In addition, the resistor 112 has a first side connected to node 116 and a second side connected to node 150. As such, when the output of the electronic switch is closed the resistor 112 is connected between node 116 and 136 and also in parallel with the input and output of the voltage regulator 110. Therefore, when the switch 148 is closed the electronic switch is connected between nodes 150 and 136 and thus the switch and resistor 112 are connected in series. The current passing through both resistor 112 and closed switch 148 is denoted by arrow 120. A resistor 149 (R2) is connected between node 136 and node 142. The output current is denoted by arrow 148 passing through resistor 149, disregarding the tiny current flowing through zener diode 144. In addition, a capacitor 138 is connected between node 136 and an electrical reference 140 such as electrical ground. Also, a zener diode 144 is connected between node 136 and electrical reference 146 such as electrical ground. A cathode of zener diode 144 may be connected to the output of voltage regulator 110 while the anode of zener diode 144 may be connected to the electrical reference 146 such as electrical ground. Finally, the circuitry inside the electronic switch is not given since it common known circuitry. The important thing to remember about this electronic switch is that it is provided in order to allow connection of resistor 112 across the input and output of voltage regulator 110 when the control circuitry decides this connection is needed.

In order to expand the supply input voltage range and still keep the power sharing/boost function, a resistor 112 (R) was added across the input and output of the voltage regulator 110 and zener diode 144 was added on the output of the voltage regulator 110. Connecting the resistor 112 across the input and output of the voltage regulator 110, via the closed switch 148, eliminates the input diode drop used in other circuits completely and may reduce the overall cost of the supply circuit. The zener diode 144 and resistor 149 were added in order to insure that the output voltage is clamped to a safe level in case for any reason the voltage regulator 110 (for example an LM2931) temporarily loses regulation. This could occur during circuit start-up or load-dump testing.

With this circuit topology the resistor 112 will always be capable of dissipating power=$(V_{IN}-V_{OUT})^2/R$ and will source current $I_R=(V_{IN}-V_{OUT})/R$ to the load. The selection of the value of the resistor 112 and its power rating is a function of the end-use voltage/current requirements of the voltage regulator load. If the resistance value is not chosen correctly it is possible for the voltage regulator 112 to go out of regulation permanently at supply voltages close to the maximum supply voltage because the voltage regulator would not be passing enough current to keep it in regulation.

From FIG. 1 above it is clear that:

$$I_S=I_R+I_{IN} \quad (1)$$

$$I_L=I_R+I_0 \quad (2)$$

$$I_{IN}=I_0+I_B \quad (3)$$

The value for resistor 112 (R) may be selected by starting with the load current. For this example it will be given that the load current $I_L$=0.020 A.

The resistance value of resistor 112 can be calculated when the power supply circuit is dissipating maximum power within normal supply voltage range (i.e. not under over-voltage mode). The voltage $V_{IN}$=20V was chosen.

$I_0$ can be chosen to be=0.001 A under worst-power dissipation. Using formula 2 above and solving for $I_R=I_L-I_0$, $I_R$=0.020 A−0.001 A=0.019 A. Using formula $I_R=(V_{IN}-V_{OUT})/R$ and solving for R, $R=(V_{IN}-V_{OUT})/I_R$, R=(20V−4.65V)/(0.019 A)=808 ohms. Prototype testing proved that a value of 1K for resistor 112 (R) may be the best choice. The power dissipated by regulator 110 (VR1) is $P(VR1)=I_B*V_{IN}+I_0*(V_{IN}-V_{OUT})$.

Figure 2:
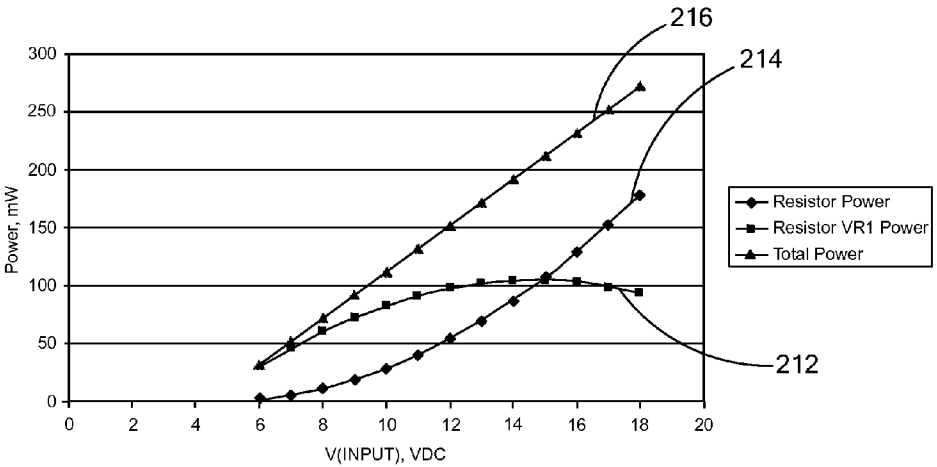
FIG. 2 is a graph illustrating power sharing between resistor 112 and the voltage regulator 110 in FIG. 1.

Now referring to FIG. 2, a graph of resistor 112 and voltage regulator 110 power sharing is provided. Curve 212 represents the power dissipated by resistor 112. Curve 214 illustrates the power dissipated by voltage regulator 110. Line 216 illustrates total power dissipated, resistor power plus regulator power. FIG. 2 illustrates how the power sharing levels change between the resistor 112 and regulator 110 (VR1) as $V_{INPUT}$ changes. $I_S$=20 mA and a constant current level of $I_B$=1 mA was chosen for illustration purposes only and to keep things simplesince in the actual circuit it may vary. As illustrated by the graph the resistor 112 dissipates the same amount of power as the regulator 110 (VR1) when the supply voltage $V_{IN}$=15 VDC. Finally, as the supply voltage increases the resistor 112 dissipates more power and the power dissipation of the voltage regulator 110 reaches a plateau and then starts to decrease.

Figure 3:
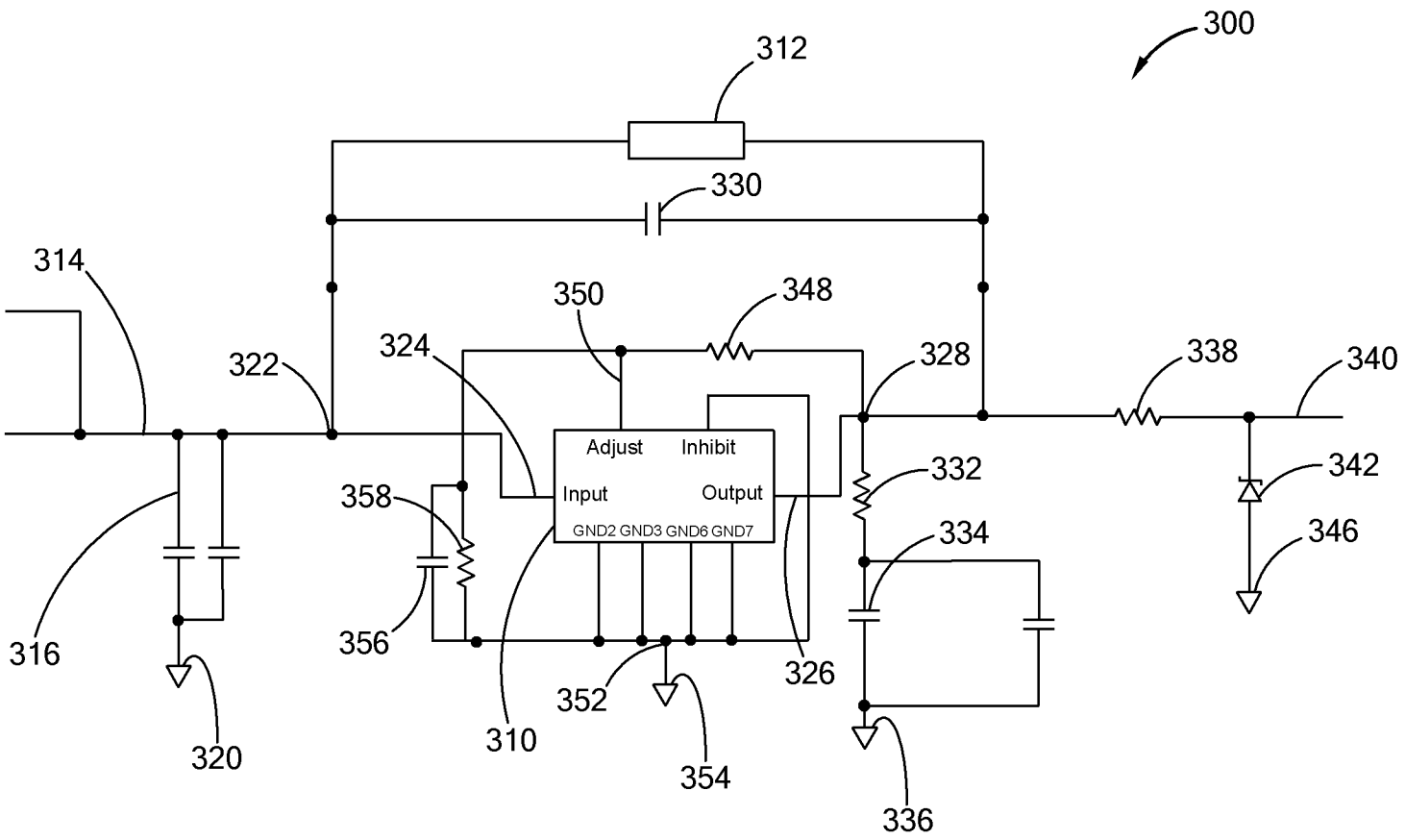
FIG. 3 is another implementation of a voltage controlling circuit with power sharing components.

FIG. 3 provides another circuit 300 illustrating one end use application of the previously described power sharing circuit. The input voltage is illustrated by reference number 314 and connected to node 322. For filtering purposes, a capacitor 316 is also connected between node 322 and an electrical reference 320 such as electrical ground. The input 324 of the voltage regulator 310 is also connected to node 322. The output 326 of the voltage regulator 310 is connected to node 328. In addition, a first side of resistor 312 is connected to node 322 while a second side of resistor 312 is connected to node 328. As such, the resistor 312 is in electrical parallel connection with the input 324 and output 326 of the voltage regulator 310. In addition, a first side of a capacitor 330 may be connected to node 322 while a second side of capacitor 330 may be connected to node 328, such that the capacitor 330 may also be in electrical parallel connection with both the resistor 312 and the voltage regulator 310. Node 328 is also in communication with an output 340 through resistor 338. Further, node 328 may be in communication with an electrical reference 336 such as electrical ground through a resistor 332 and a capacitor 334. The resistor 332 may be in electrical series connection with the capacitor 334 between node 328 and reference 336. As such, a first side of resistor 332 may be in connection with node 328 while a second side of resistor 332 may be in connection with a first side of capacitor 334. Further, a second side of capacitor 334 may be in connection with the electrical reference 336.

Also, node 328 may be in communication with an adjust output 350 of the voltage regulator 310. As such, the output 326 is connected to the adjust pin 350 of the voltage regulator 310 through resistor 348. In addition, the adjust pin 350 may be in communication with an electrical reference 354 such as electrical ground through a resistor 358 and capacitor 356. The resistor 358 and the capacitor 356 may be an electrical parallel connection between the adjust pin 350 and the reference 354. Accordingly, a first side of the resistor 358 and a first side of the capacitor 356 may be an electrical connection with adjust pin 350 while a second side of capacitor 356 and a second side of resistor 358 are in electrical connection with the reference 354. In addition, other pins of the voltage regulator 310 such as the ground pins and the output inhibit pin may be tied to node 352 and, in effect, the reference voltage 354, such as electrical ground. Further, the second side of resistor 338 that is connected to the output voltage 340 may be connected to a zener diode 342. The zener diode may have a cathode connected to the output voltage and an anode connected to an electrical reference 346 such as electrical ground.

Figure 4:
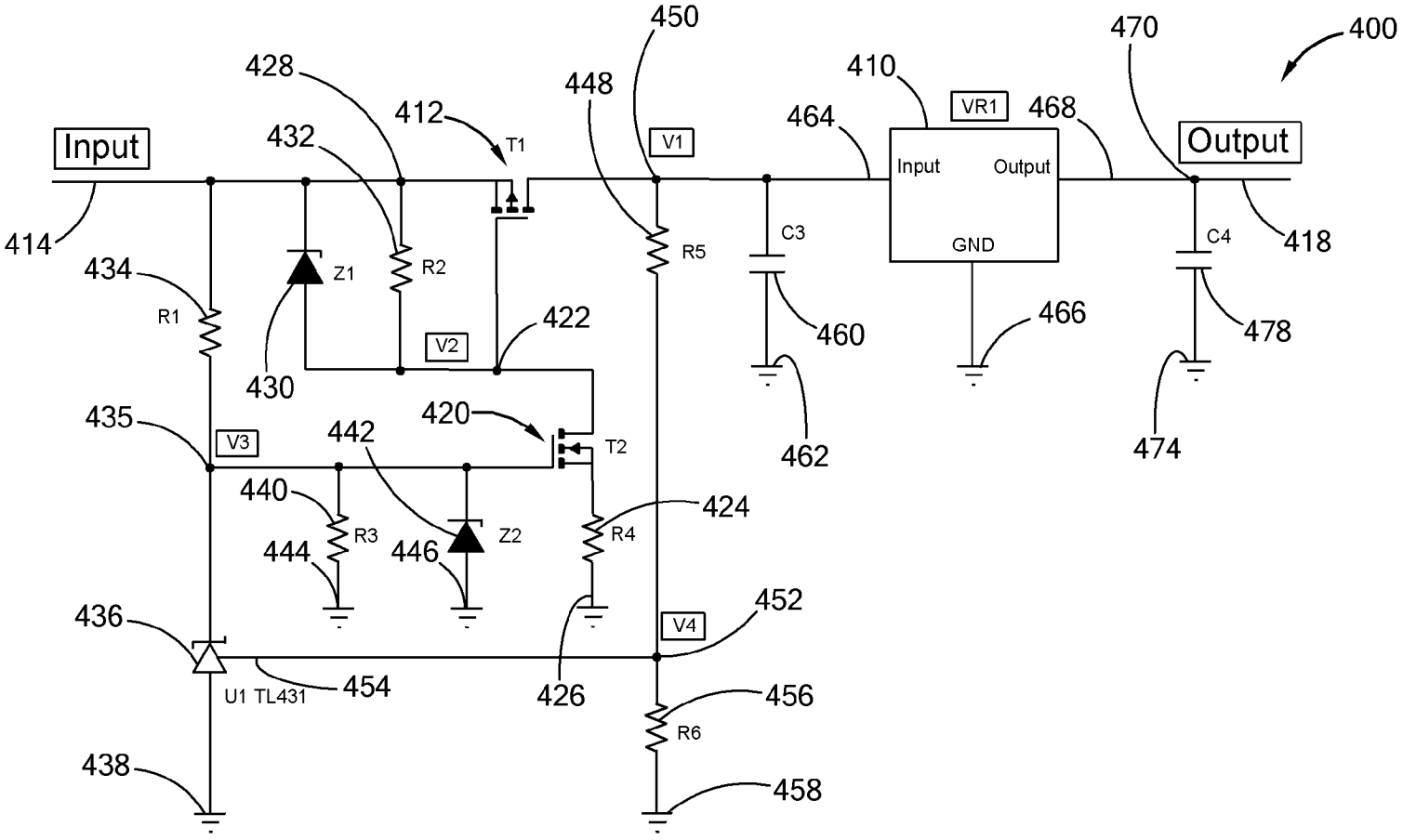
FIG. 4 is another implementation of a voltage controlling circuit with power sharing.

Now referring to FIG. 4, a circuit 400 is provided for controlling voltage. The circuit 400 includes a voltage regulator 410 and a transistor 412 in electrical series connection. The input voltage is provided to the circuit 400 as denoted by reference numeral 414. The input voltage 414 is provided to node 428. A source of transistor 412 is connected to node 428. The drain of transistor 412 is connected to node 450 which is also connected to the input of voltage regulator 410. Transistor 412 may be a P-channel field effect transistor (FET). The output 468 of the voltage regulator 410 is connected to node 470. Node 470 is also connected to the voltage output of the circuit as denoted by reference numeral 418. Referring again to transistor 412, the gate of transistor 412 may be connected to node 422. As such, the gate of transistor 412 is controlled by transistor 420. Transistor 420 may be a N-Channel FET. In addition, the source of transistor 420 may be connected to an electrical reference 426 such as electrical ground through a resistor 424. Further, a resistor 432 may be connected between node 422 and node 428. In addition, a zener diode 430 has a cathode connected to node 428 and an anode connected to node 422. As such, the resistor 432 and the zener diode 430 may be in a parallel electrical connection between nodes 422 and 428 and therefore, in effect, between the gate of transistor 412 and the source of transistor 412.

The gate of transistor 420 may be connected to node 428 through resistor 434. As such, resistor 434 and the gate of transistor 420 may be connected to node 435. Resistor 440 is connected between node 435 and an electrical reference 444, such as an electrical ground. In addition, a zener diode 442 is connected between node 435 and an electrical reference 446 such as electrical ground. As such, resistor 440 and zener diode 442 are connected in an electrically parallel connection between node 435 and electrical ground. It is further noted that the cathode of zener diode 442 may be connected to node 435 while the anode of zener diode 442 may be connected to electrical reference 446. Further, a shunt voltage regulator 436 may be connected between node 435 and electrical reference 438 such as electrical ground. In addition, the shunt voltage regulator 436 has a feedback input 454 which is used to control transistor 420 and in turn transistor 420 controls transistor 412.

Further, with regard to node 450, resistor 448 is connected between node 450 and node 452. As such, one side of resistor 448 is connected to the drain of transistor 412 and the other side of resistor 448 is connected to the feedback input 454 of shunt voltage regulator 436 and resistor 456. Further, resistor 456 is connected between node 452 and electrical reference 458 such as electrical ground. Further, the feedback input 454 of shunt voltage regulator 436 is connected to node 452. Also, capacitor 460 is connected between node 450 and an electrical reference 462, such as electrical ground. A ground input of voltage regulator 410 is connected to an electrical reference 466 such as electrical ground. In addition, at node 470, capacitor 472 is connected between node 470 and an electrical reference 474, such as electrical ground, to filter the output 418 from the voltage regulator 410. This circuit expands the supply input voltage range and makes the power dissipation sharing smarter due to the feedback mechanism.

Further, this circuit allows a p-channel FET, for example transistor 412, to share power dissipation with voltage regulator 410 (VR1). Since the transistor 412 (T1) as chosen may have a higher maximum junction temperature than the voltage regulator 410 (VR1), transistor 412 can be pushed harder than voltage regulator 410 (VR1) in terms of power dissipation. In essence the circuitry added to the voltage regulator 410 (VR1) creates a voltage control circuit with a non-typical high junction temperature rating. This added circuitry is connected in series with voltage regulator 410 (VR1). Transistor 412 (T1) is controlled by transistor 420 (T2). Further, transistor 420 (T2) is controlled by shunt voltage regulator 436 (U1). The output of the shunt voltage regulator 436 (U1) is set/controlled by the feedback voltage 454 (V4) which is a fraction of the voltage 450 (V1), at the drain of transistor 412 (T1). In order to maximize power sharing between transistor 412 (T1) and voltage regulator 410 (VR1) the target voltage 450 (V1) can be selected, for example in one example 450 (V1) was equal to 7.5 VDC.

First the selection of the input voltage V1 will be discussed. Shunt voltage regulator 410 (U1) may have an internal voltage reference equal to 2.5 VDC and this reference is connected to one input of an internal op-amp. The other op-amp input is connected to the regulation pin 454 of shunt voltage regulator 410 (U1), the one connected to resistor 456 (R6). Therefore, in order to set V1 to a voltage of 7.5 VDC, voltage V4 at node 452 needs to equal 2.5 VDC when V1 at node 450 equals 7.5 VDC. Knowing that V4=V1*R6/(R5+R6), choosing V4=2.5 VDC, choosing V1=7.5 VDC, and choosing a value for resistor 448 such that R5=100K ohms, the value for resistor 456 (R6) may be determined. Using R6=R5*V4/(V1−V4) gives R6=100K*2.5/(7.5−2.5)=50K ohms.

Next a value for resistor 434 (R1) can be selected. Since the specification sheet for the shunt voltage regulator 436 (U1) recommends that a minimum current of 0.5 mA passes through cathode-anode in order to guarantee correct operation, the resistance of resistor 434 (R1) was chosen to draw at least this amount of current when the input voltage 414 is in the range where a voltage drop is needed between the source and drain of transistor 412.

Figure 5:
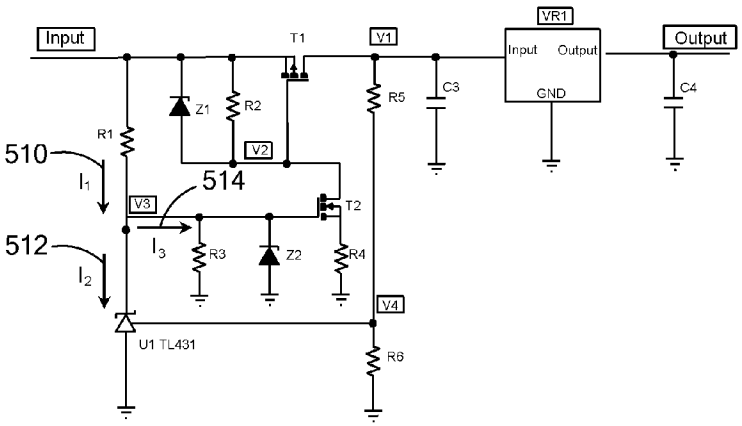
FIG. 5 is the voltage controlling circuit of FIG. 4 illustrating current flow through a first portion of the circuit.

Now referring to FIG. 5, the current draw from the shunt voltage regulator 436 and the transistor 420 are discussed in more detail. Arrow 510 represents current I1 while arrow 512 represents current I2 through the shunt voltage regulator 436. In addition, arrow 514 represents current I3 through the gate of the transistor 420. From FIG. 5, it can be determined that I1=I2+I3. Current I1=($V_{INPUT}$−V3)/R1. Since the design targets drawing the recommended current when $V_{INPUT}$ is ≥10 VDC, resistor 434 (R1) was chosen=10K. When the circuit is operating and transistor 412 (T1) is in the linear region, not saturated, the voltage V3 is centered around 2.5 VDC. When $V_{INPUT}$=6 VDC, the maximum possible I1 current is determined as follows: V3=2.5 VDC, and R1=10K, solving for I1 gives I1=(6−2.5)/10000=0.35 mA. Solving for I3, I3=V3/R3=2.5/100K=25 uA. Solving for I2=I1−I3=0.35 mA−0.025 mA=0.325 mA. This current does not meet the minimum current recommended by the manufacturer; however, when Vinput=6V, the shunt regulator will send the cathode voltage in the opposite direction>2.5V causing I2 to be even less than the recommended current draw of 0.5 mA. This condition is not a problem since when $V_{INPUT}$=6 VDC it does not matter that the minimum current limit is met since even if the shunt voltage regulator 436 (U1) was open, drawing no current from cathode to gnd, the needed voltage on the gate of transistor 420 (T2) would be V3=$V_{INPUT}$*R3/(R1+R3)=6*100K/(10K+100K)=5.45 VDC. The voltage 5.45V would be more than enough to keep transistor 420 (T2) fully closed/saturated which in turn keeps transistor 412 (T1) fully closed/saturated and thus passes almost all of the $V_{INPUT}$ voltage to the input of the voltage regulator 410 (VR1), which is the goal when the supply voltage is at its minimum level. When $V_{INPUT}$=12 VDC, V3=2.5 VDC, and R1=10K, solving for I1 gives I1=(12−2.5)/10000=0.95 mA. Similarly, I3=V3/R3=2.5/100K=25 uA. Solving for I2=I1−I3=0.95 mA−0.025 mA=0.925 mA. This current does meet the 0.5 mA minimum current recommended by the manufacturer.

Figure 6:
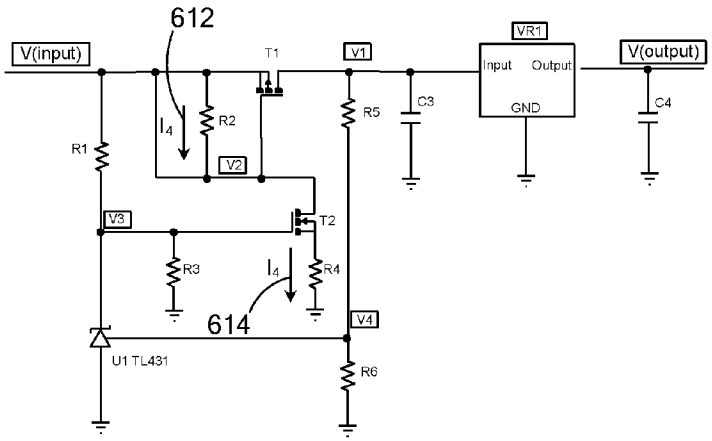
FIG. 6 is the voltage controlling circuit of FIG. 4 illustrating current flow through a second portion of the circuit.

Now referring to FIG. 6, the current through transistor 420 is discussed with regard to the values of resistor are 432 and 424 is discussed in more detail. As such, arrow 612 represents the current I4 through resistor 432 and arrow 416 represents the current I4 through resistor 424. Resistance values for resistors 432 (R2) and resistor 424 (R4) are determined next. FIG. 6 is the same as FIG. 5 except the zener diodes were removed for illustrative purposes, since the zener diodes are not active during normal operation, only during over-voltage fault conditions.

When $V_{INPUT}$=6 VDC the voltage drop across resistor 432 (R2) needs to be greater or equal to 2.5 VDC since this is the amount of voltage needed across the gate and source of transistor 412 (T1) in order to keep the output of transistor 412 (T1) saturated. A current draw of I4=0.5 mA was chosen as a target. Since I4*R2≥2.5 VDC, solving for R2, R2≥2.5 VDC/0.0005 A, R2≥5K.

At $V_{INPUT}$ close to 7.5 VDC or greater, using a target V1=7.5 VDC, the shunt voltage regulator 436 (U1) needs to be able to open the drain to source junction of transistor 420 (T2) enough to in turn regulate the output of transistor 412 (T1). In order for the shunt voltage regulator 436 (U1) to be able to control transistor 420 (T2) the source of transistor 420 (T2) has to be biased above ground since the lowest voltage it can reach at its cathode is 2.5V. Testing has proved that a value of R2=7.5K and R4=2.2K gave the best results for the regulation of voltage V1. Assuming that the RdsON of transistor 420 (T2) is very low compared to the values of resistor 432 (R2) and resistor 424 (R4) so that it can be disregarded, when transistor 420 (T2) is fully closed, V2=$V_{INPUT}$*R4/(R2+R4). Therefore, when $V_{INPUT}$=6 VDC, the voltage across transistor 432 (R2) is equal to $V_{INPUT}$−V2=6−6*2.2/(7.5+2.2)=4.64V. This voltage is more than enough to fully close transistor 412 (T1), which is the goal. When Vinput=16 VDC and transistor 420 (T2) is fully closed the worst case current draw through resistor 432 (R2) and resistor 424 (R4) is equal to I4=$V_{INPUT}$/(R2+R4)=16/(7500+2200)=1.65 mA. The voltage drop across resistor 424 (R4) is equal to I4*R4=0.00165*2200=3.63 VDC. This voltage is definitely high enough for the shunt voltage regulator 436 (U1) to fully open transistor 420 (T2) and in turn fully open transistor 412 (T1) when the output of the shunt voltage regulator 436 (U1) goes to its minimum value of 2.5 VDC. When the cathode of the shunt voltage regulator 436 (U1) goes down to its minimum value, V3=2.5 VDC, the voltage present across the gate-to-source of transistor 420 (T2) would be equal to V3−V (T2 source)=2.5 VDC−3.63 VDC=−1.13 VDC. This voltage is definitely low enough to open both transistor 412 (T1) and transistor 420 (T2) completely if needed.

Figure 7:
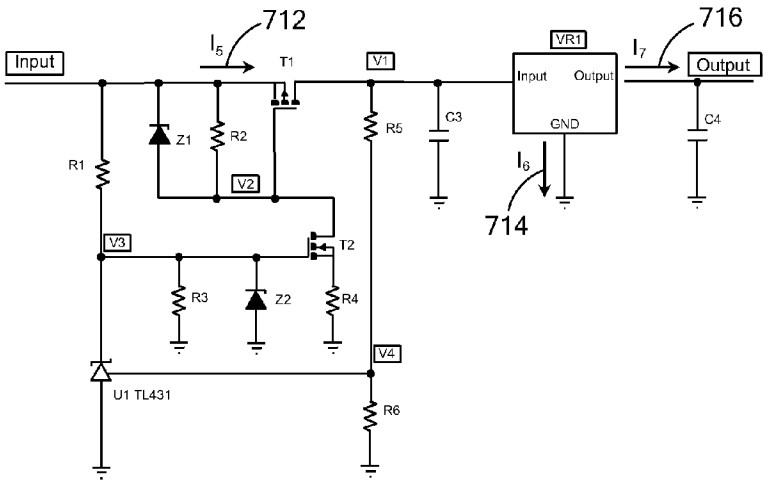
FIG. 7 is the voltage controlling circuit of FIG. 4 illustrating current flow through a third portion of the circuit.

Now referring to FIG. 7, the current draw and power dissipation with respect to transistor 412 (T1) and voltage regulator 410 (VR1) is discussed in more detail. Arrow 712 represents the current I5 through the source of transistor 412. In addition, arrow 714 represents the current I6 through the voltage regulator 410 to ground while arrow 716 represents current I7 through the output of the voltage regulator 410. The power dissipated by transistor 412 and voltage regulator 410 can be calculated easily by disregarding the current draw by the feedback resistor branch (R5 and R6) and biasing branch (R2, T2, and R4) since it is small compared to current I5 and the current draw by the gate of transistor 412 (T1), then a rough power comparison between transistor 412 (T1) and voltage regulator 410 (VR1) can be made by declaring I5=I6+I7. Therefore, the power dissipated by transistor 412 (T1) is approximately equal to P(T1)=I5*($V_{INPUT}$−V1) and the power dissipated by voltage regulator 410 (VR1) is approximately equal to P(VR1)=I6*V1+I7*(V1−$V_{OUTPUT}$). During normal operating conditions, I5=20 mA, I6=1 mA, $V_{OUTPUT}$=4.65V. When the supply voltage $V_{INPUT}$=12V, the power dissipated by transistor 412 (T1) is P(T1)=0.020 A*(12V−7.5V)=90 mW and the power dissipated by voltage regulator 410 (VR1) is P(VR1)=0.001 A*7.5V+0.019 A*(7.5V−4.65V)=0.0075+0.0542=61.7 mW. The total power dissipated by the power supply system is equal to the sum of the power dissipated by transistor 412 (T1) and the voltage regulator 410 (VR1), P(total)=P(FET1)+P(VR1). At a supply voltage of Vinput=12 VDC, the total power is approximately equal to P(total)=90 mW+61.7 mW=151.7 mW.

Figure 8:
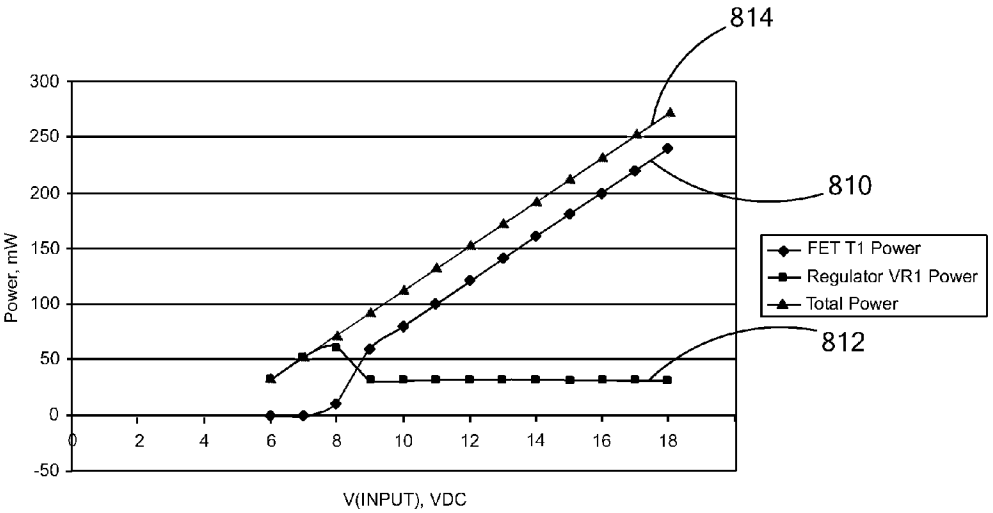
FIG. 8 is a graph illustrating power sharing between the transistor 412 and the voltage regulator 410 of FIG. 4.

Now referring to FIG. 8, the power sharing between transistor 412 (T1) and voltage regulator 410 (VR1) is discussed in more detail. Line 810 represents the power through the transistor 412. Line 812 represents the power through the voltage regulator 410. While line 814 represents the total power=voltage regulator power+transistor power. The power was calculated as described in the previous section. FIG. 8 illustrates how the power sharing levels change between the transistor 412 (T1) and voltage regulator 410 (VR1) as $V_{INPUT}$ changes. This graph illustrates that transistor 412 (T1) dissipates a large percent of the total power as the supply voltage increases and the power consumption by the voltage regulator 410 (VR1) stays constant after a supply voltage $V_{INPUT}$ of 9 volts.

Figure 9:
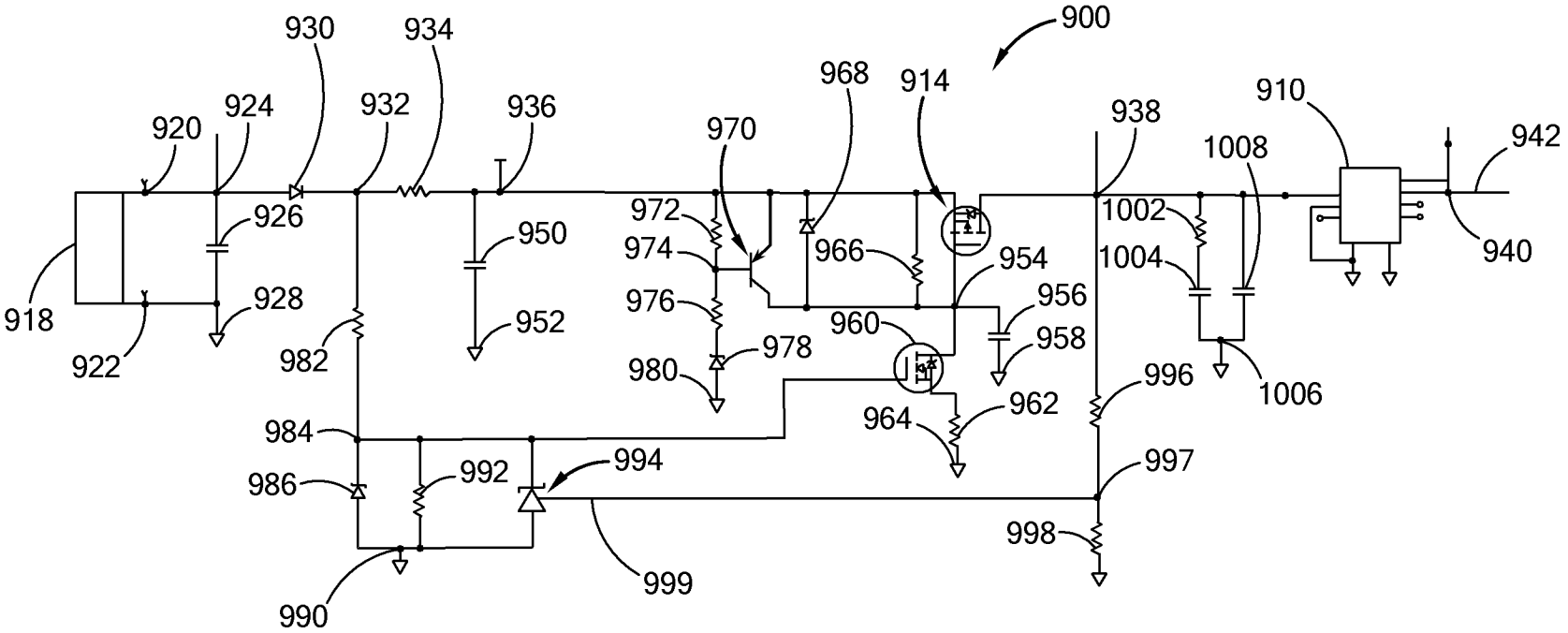
FIG. 9 is another implementation of a voltage controlling circuit with power sharing components.

Now referring to FIG. 9, another circuit is provided that illustrates the use of the previously described circuit in one end use application. The circuit uses a transistor 914 in series with a voltage regulator 910. An input voltage 920 is provided, for example, by a voltage supply 918. The input voltage 920 is provided to a node 924. Further, a reference voltage such as electrical ground 922 may also be provided by the voltage regulator 918. As such, a capacitor 926 may be connected between the input voltage 920 and the electrical reference 928 for filtrating purposes. In addition, a diode 930 may be connected to node 924 to receive the input voltage 920. An anode of diode 930 may be connected to node 924 while a cathode of diode 930 may be connected to node 932. A resistor 934 may be connected on one side to node 932 and on a second side to a node 936 to receive a portion of the current flow through the diode 930. Node 936 is connected to a source of transistor 914. In addition, a drain of transistor 914 is connected to a node 938. An input voltage pin of voltage regulator 910 is connected to node 938 as well. As such, the drain of transistor 914 is connected to voltage regulator 910. Further, the voltage output pin of the voltage regulator 910 is connected to node 940. Node 940 communicates an output voltage 942 for the circuit 900.

The transistor 914 may be a P-channel field effect transistor. The gate of the transistor 914 may be connected to node 954. Node 954 may also be connected to the drain of transistor 960. As such, transistor 960 may control the gate of transistor 914. The source of transistor 960 may be connected to an electrical reference 964 such as electrical ground through resistor 962. In addition, a capacitor 956 is connected between node 954 and an electrical reference 958 such as electrical ground. Also, a resistor 966 is connected between node 954 and node 936 or effectively the source of transistor 914. Also, a zener diode 968 is connected from node 954 to node 936 or effectively the source of transistor 914. As such, the resistor 966 and the zener diode 968 may be in an electrically parallel connection between nodes 954 and node 936, but more specifically, between the gate of transistor 914 and the source of transistor 914. In addition, transistor 970 may have a source and a drain that are also in electrically parallel connection with the zener diode 968 and the resistor 966 between the gate of transistor 914 and the source of transistor 914. Transistor 970 may be a bipolar transistor. The emitter of the transistor 970 may be connected to node 936 while the collector of transistor 970 may be connected to node 954. Further, the control input such as the base of transistor 970 may be connected to node 974. Resistor 972 may be connected between node 974 and node 936. Accordingly, the control input of transistor 970 may be connected to the source of transistor 970 and the source of transistor 914 through resistor 972. Also, resistor 976 and zener diode 978 are connected in series between node 974, and therefore the control input of transistor 970, and an electrical reference 980 such as electrical ground. The zener diode 978 may be connected in a manner such that the cathode of diode 978 is on the side of node 974 and the anode of diode 978 is on the side of an electrical reference 980. In addition, capacitor 950 is connected between node 936 in an electrical reference voltage 952 such as electrical ground.

Transistor 960 may be a N-channel field effect transistor. Further, the gate of transistor 960 may be connected to node 984. Node 984 is connected to node 932 through resistor 982. As such, the gate of transistor 960 is connected to the source or transistor 914 through resistors 982 and resistor 934. In addition, a first zener diode 986, resistor 992 and a shunt voltage regulator 994 are all connected in parallel between node 984, and therefore the gate of transistor 960, and an electrical reference such as 990 such as ground. The first zener diode 986 has cathode connected to node 984 and a anode connected to electrical reference 990. The resistor 992 has a first side connected to node 984 and a second side connected to the electrical reference 990. The shunt voltage regulator 994 includes a feedback input 999. The feedback input 999 is connected to node 997. Node 997 is connected to node 938, and therefore the drain of transistor 914 through resistor 996. In addition, node 997 is connected to an electrical reference such as electrical ground through resistor 998. As such, feedback input 999 is connected through the voltage input of voltage regulator 910. In addition, node 938 may be connected to reference 1006 such as electrical ground through capacitor 1008 and also through the series connection of resistor 1002 and capacitor 1004. As such, capacitor 1008 is connected between electrical reference 1006 and node 938. Further, first side of resistor 1002 may be connected to node 938 while a second side of resistor 1002 may be connected to capacitor 1004. Further, a second side of capacitor 1004 may be connected to electrical reference 1006. Accordingly, resistor 1002 as well as capacitor 1004 is in parallel electrical connection with capacitor 1008 between node 938 and electrical reference 1006 to filter the input voltage to voltage regulator 910.

As a person skilled in the art will readily appreciate, the above description is meant as an illustration of implementation of the principles of this invention. This description is not intended to limit the scope or application of this invention in that the invention is susceptible to modification, variation and change, without departing from the spirit of this invention, as defined in the following claims.

We claim:

1. A voltage controlling circuit with power sharing components, the circuit comprising:

a voltage regulator for controlling an output voltage for a load;

a first transistor connected in series with the voltage regulator for sharing power dissipation with the voltage regulator, the first transistor being disposed between an input of the voltage regulator and an electrical reference voltage;

a shunt voltage regulator connected between the first transistor and the electrical reference voltage, the shunt voltage regulator having a feedback input that controls the first transistor;

a second transistor connected between the first transistor and the shunt voltage regulator, wherein a gate of the second transistor is connected to the shunt voltage regulator; and a current regulating device directly connected between the source of the first transistor and the gate of the first transistor.

2. The circuit according to claim 1, wherein the source of the first transistor is connected to a circuit input voltage.

3. The circuit according to claim 2, wherein a drain of the first transistor is connected to an input voltage of a voltage regulator.

4. The circuit according to claim 3, wherein the gate of the first transistor is connected to the source of the first transistor through a resistor.

5. The circuit according to claim 4, wherein the second transistor is connected between the gate of the first transistor and an electrical reference voltage.

6. The circuit according to claim 5, wherein a source of the second transistor is connected to an electrical reference voltage through a resistor.

7. The circuit according to claim 6, wherein a drain of the second transistor is connected to the gate of the first transistor.

8. The circuit according to claim 7, wherein a gate of the second transistor is connected to the source of the first transistor through a resistor.

9. The circuit according to claim 5, wherein the second transistor controls the first transistor through the shunt voltage regulator.

10. The circuit according to claim 9, wherein the cathode of the second voltage regulator is connected to the gate of the second transistor and to a circuit power source reference.

11. The circuit according to claim 10, wherein the cathode of the second voltage regulator is connected to a resistor and the other end of the resistor is connected to the circuit power source reference.

12. The circuit according to claim 11, wherein a feedback input of the second voltage regulator is connected to a percentage of the input voltage of the first voltage regulator.

13. The circuit according to claim 12, wherein the feedback input of the second voltage regulator is connected to a first resistor and the other end of the resistor is connected to a circuit reference.

14. The circuit according to claim 13, wherein the feedback input of the second voltage regulator is connected to a second resistor and the other end of the resistor is connected to the input of the first voltage regulator.

15. The circuit according to claim 1, wherein shunt voltage regulator is a zener diode.

16. The circuit according to claim 1, wherein the current regulating device is a zener diode.

17. The circuit according to claim 1, wherein the zener diode has a cathode end directly connected to the source of the first transistor and an anode end direct connected to the gate of the first transistor.

* * * * *